US007990239B2

(12) United States Patent
Brown et al.

(10) Patent No.: US 7,990,239 B2
(45) Date of Patent: Aug. 2, 2011

(54) ELECTRICITY METER CONTACT ARRANGEMENT

(75) Inventors: Michael R. Brown, Mandeville, LA (US); William R. Mazza, Jr., Harrison City, PA (US); Oliver Burstall, Catworth (GB); Alan Syrop, Royston (GB)

(73) Assignee: M&FC Holding, LLC, Raleigh, NC (US)

( * ) Notice: Subject to any disclaimer, the term of this patent is extended or adjusted under 35 U.S.C. 154(b) by 291 days.

(21) Appl. No.: 12/437,594

(22) Filed: May 8, 2009

(65) Prior Publication Data

US 2010/0282579 A1 Nov. 11, 2010

(51) Int. Cl.
*H01H 1/20* (2006.01)
*H01H 3/00* (2006.01)

(52) U.S. Cl. ..... 335/106; 335/131; 335/132; 335/133; 335/179; 335/190; 335/194; 335/195; 200/16 R; 200/239; 200/243

(58) Field of Classification Search ..... 335/106, 335/127, 131–133, 179, 190, 194, 195; 200/16 R, 200/16 A, 16 B, 16 C, 16 D, 16 F, 239, 243
See application file for complete search history.

(56) References Cited

U.S. PATENT DOCUMENTS

| | | | |
|---|---|---|---|
| 1,400,281 | A | 12/1921 | Freeman et al. |
| 3,544,742 | A | 12/1970 | Frink |
| 4,039,943 | A | 8/1977 | Tapscott |
| 5,575,309 | A | 11/1996 | Connell |
| 5,694,099 | A | 12/1997 | Connell et al. |
| 6,046,660 | A | 4/2000 | Gruner |
| 6,246,306 | B1 | 6/2001 | Gruner |
| 6,252,478 | B1 | 6/2001 | Gruner |
| 6,292,075 | B1 | 9/2001 | Connell et al. |
| 6,563,409 | B2 | 5/2003 | Gruner |
| 6,661,319 | B2 | 12/2003 | Schmelz |
| 6,788,176 | B2 | 9/2004 | Schmelz |
| 6,836,108 | B1 | 12/2004 | Balko et al. |
| 6,906,637 | B2 | 6/2005 | Martin |
| 6,972,555 | B2 | 12/2005 | Balko et al. |
| 7,049,932 | B2 | 5/2006 | French et al. |

(Continued)

FOREIGN PATENT DOCUMENTS

| | | |
|---|---|---|
| DE | 305257 | 4/1918 |

(Continued)

OTHER PUBLICATIONS

U.S. Appl. No. 12/437,596, filed May 8, 2009; Brown et al; Magnetic Latching Actuator.

(Continued)

*Primary Examiner* — Ramon M Barrera
(74) *Attorney, Agent, or Firm* — Andrus, Sceales, Starke & Sawall, LLP

(57) ABSTRACT

At least one electrical contactor is provided that includes a fixed contact and a movable contact. The fixed contact includes a center leg and first and second arms that extend in opposite directions from the center leg. The movable contact associated with each fixed contact includes first and second blades positioned on opposite sides of the center leg. The first and second blades extend parallel to the center leg of the fixed contact such that when current flows through the electrical contactor, the current flow creates a force to push the first and second blades into the first and second arms of the fixed contact. The electrical contactor includes an actuating arrangement having a pair of cam members. The movement of the cam members causes pegs on each of the first and second blades to travel within the cam channel, thus opening and closing the contactor arrangement.

23 Claims, 7 Drawing Sheets

U.S. PATENT DOCUMENTS

| | | | |
|---|---|---|---|
| 7,362,232 | B2 | 4/2008 | Holle et al. |
| 2009/0294260 | A1 | 12/2009 | Makinson et al. |

FOREIGN PATENT DOCUMENTS

| | | | |
|---|---|---|---|
| DE | 478488 | | 6/1929 |
| GB | 2413703 | B | 3/2007 |
| WO | 2005106907 | A1 | 11/2005 |
| WO | 2006024855 | A1 | 3/2006 |
| WO | 2007012883 | A1 | 2/2007 |

OTHER PUBLICATIONS

International Search Report dated Sep. 13, 2010.

ELECTRICITY METER CONTACT ARRANGEMENT

BACKGROUND

The present disclosure generally relates to electrical contactors for use within an electricity meter. More specifically, the present disclosure relates to electrical contactors that are utilized within a domestic electricity meter to selectively connect or disconnect the electricity mains to a home or business serviced through the electricity meter.

Domestic homes and small businesses receive electricity from a main through an electricity meter that includes circuitry for measuring the amount of electricity consumed by the home. Typically, the electricity meter includes two bus bars each having an infeed blade connected to the electricity mains and an outfeed blade connected to the wiring of the home. In electronic electricity meters, circuitry within the electricity meter measures the amount of electricity consumed, typically across two phases. In North America, for example, the two bus bars in an electricity meter provides phase voltages at approximately 115 volts to neutral for low power distributed sockets or 230 volts across both phases for high power appliances such as washing machines, dryers and air conditioners, representing load currents up to 200 amps.

In many currently available electronic electricity meters, such as the Icon® meter available from Sensus Metering Systems, the electricity meter includes a radio that can receive and transmit signals to and from locations remote to the meter. The ability of the electronic electricity meter to receive information from locations/devices remote to the meter allows the electronic electricity meter to perform a variety of functions, such as reporting electricity consumption and selectively disconnecting the home from the electrical mains. As an example, utility providers may require some homes to pre-pay for electricity. When the prepayment amount has been consumed, the utility may desire to disconnect the electricity mains from the consumer's home to prevent further electricity consumption. Alternatively, the utility may wish to disconnect the electrical mains to a home for any number of other reasons.

Many metering specifications demand that any component included within the meter that is subjected to excess overload current conditions, including power disconnect contactors, must be capable of surviving demanding overload criteria, especially when subjected to a range of potentially damaging short-circuit fault conditions. As an example, commonly utilized testing standards require the contactors within the meter to survive an overload condition thirty times the nominal current rating.

Contactors for domestic supply applications typically may have nominal current capacities of 200 amps. Under testing conditions, these contactors are expected to survive thirty times these nominal current values for six full supply cycles. This represents overload levels of 7,000 amps RMS or peak AC values of almost 12,000 amps.

Domestic metering power disconnect contactors have to survive this arduous overload current condition as described above. One of the issues created during the overload condition is the magnetic force created by the extremely high current values passing through the fixed feed blade and a moving contact blade during the excessive overload situation. If the contacts are arranged such that the direct current flow through the fixed and movable contacts is opposite each other, the magnetic forces may urge the contacts to separate. As an example, under standard load conditions, the magnetic force attempting to separate the contacts may be approximately 1 Newton. During overload test conditions, as many as several hundred Newtons may be acting to separate the contacts.

In such meter designs, the fixed and movable contacts are held in the closed position and moved from the closed to an open position by some type of actuator assembly. Such actuators must also be able to survive the arduous overload current conditions described during testing conditions and must hold the contact in the closed position during such testing conditions.

Another problem that exists in conventional remote disconnect switches within electricity meters is that the electrical contacts within the meter wear over the lifetime of the switch. In a 200 amp remote disconnect, where a typical contact opening distance is on the order of 2 millimeters, the wear over the lifetime of the contact components in the direction of closure can be on the order of 0.5 millimeters. This amount of wear represents a significant percentage of the overall movement of the contact.

In order to overcome this wear issue, many remote disconnect switches utilize a compliant member between the actuator and the moving contacts. This compliant member is frequently the bus bar to which the moving side of the contact pair is attached. This method of indirect application of force to the contact to achieve closure leaves the contact vulnerable to bounce, inconsistent closure force or flexing of the bus bar under high current, all of which cause increased wear and higher resistance or higher likelihood of failure.

A common actuator used for opening and closing contact pairs in commercially available remote disconnects is an electromagnetic solenoid. Electromagnetic solenoids are particularly suitable since they typically operate sufficiently quickly (within one line cycle) such that any arc struck between the contacts will extinguish at the next zero point crossing, rather than being maintained over a relatively long period. Electromagnetic solenoids used are usually bi-stable solenoids that latch at the end points of their travel by employing either mechanical or magnetic latching functions to hold the contactor state. The latching force is typically a steep function of position as the ends of the actuator travel are approached, as the reluctance drops rapidly as the moving iron parts close on the stationary iron parts, resulting in an increasing flux in the gap. The steep force curve results in the use of a compliant member described above positioned between the actuator and the moving contacts. Most compliant members have a resultant force that varies as the displacement varies. Some of these issues can be overcome by employing a constant force spring structure; however, these spring structures can be complex and have issues with dynamic response.

As described above, it is desirable to provide a combined actuator arrangement and electrical contactors within an electricity meter that allow the electricity meter to operate satisfactorily through testing conditions while also being able to separate the contacts within the electricity meter over an extended period of use.

SUMMARY

The present disclosure generally relates to an electrical contactor. More specifically, the present disclosure relates to an electrical contactor that is utilized within an electricity meter to selectively interrupt the flow of current through the electricity meter.

The electrical contactor includes a fixed contact and a movable contact that form part of one of the bus bars within the electricity meter. The fixed and movable contacts are selectively movable between a closed condition to allow the flow of current through the bus bar and an open condition to interrupt the flow of current through the bus bar. An actuating arrangement can be utilized to control the movement of the fixed and movable contacts between the open and closed conditions.

The fixed contact includes a center leg that extends along a longitudinal axis from a first end to a second end. Each fixed contact includes a first arm and a second arm that extend in opposite directions from the center leg.

The movable contact of the electrical contactor includes a first blade and a second blade positioned generally parallel to each other. The first and second blades are both parallel to each other and generally parallel to the longitudinal axis of the center leg of the fixed contact. The first and second blades are positioned on opposite sides of the center leg of the fixed contact such that the first blade is located between the first arm of the fixed contact and the center leg of the fixed contact, while the second blade is located between the second arm of the fixed contact and the center leg of the fixed contact.

When the electrical contactor is in the closed condition, the first blade of the movable contact is in physical contact with the first arm of the fixed contact. Likewise, the second blade of the movable contact is in physical contact with the second arm of the fixed contact in the closed condition.

When the movable and fixed contacts are in the closed condition, current flows through the first and second blades of the movable contact and into the first and second arms of the fixed contact. The first and second arms of the fixed contact direct the current flow through the center leg of the fixed contact. Since the center leg of the fixed contact is generally parallel to the first and second blades of the movable contact, the current flow through the first and second blades creates a magnetic field that opposes a magnetic field created by the current flow through the center leg. The opposing magnetic fields force the first and second blades outward away from the center leg. The outward movement of the first and second blades reinforces the physical contact between the first and second blades and the first and second arms of the fixed contact. The opposing magnetic fields help to prevent separation of the first and second blades from the first and second arms of the fixed contact during a short circuit condition or during high current testing.

The actuating arrangement engages the first and second blades of the movable contact to move the blades away from the fixed contact when it is desired to interrupt the current flow through the electricity meter. In one embodiment, the actuating arrangement includes a pair of cam channels that receive pegs formed on the first and second blades of the movable contact. The cam channels are arranged to move the first and second blades away from the fixed contact when separation and current interruption is desired.

In one embodiment of the disclosure, the actuating arrangement includes a magnetic latching actuator that operates to move the fixed and movable contacts between open and closed positions. The magnetic latching actuator includes a first stationary magnet positioned to create a first magnetic field having a first polarity. A second permanent magnet is positioned relative to the first permanent magnet to create a second magnetic field that has a second polarity opposite the first polarity. An actuation coil surrounds both the first and second permanent magnets and is connected to a current source. When current is applied to the actuation coil in a first direction, the actuation coil creates a magnetic field that enhances the first magnetic field while effectively cancelling the second magnetic field. When current is applied to the actuation coil in a second, opposite direction, the actuation coil creates a magnetic field that enhances the second magnetic field while at the same time effectively cancelling the first magnetic field. In this manner, the direction of current flow through the actuation coil controls the relative strengths of the two magnets in the magnetic latching actuator.

The magnetic latching actuator further includes a yoke that surrounds the actuation coil and is movable relative to the first and second permanent magnets. In one embodiment, the yoke is formed from two separate yoke sections each formed from a permeable material. The yoke sections are separated by a pair of guide slots that each receive one of a pair of guide ribs formed as part of the actuating arrangement. Interaction between the guide slots and the guide ribs directs movement of the yoke relative to the first and second permanent magnets. In the absence of actuation current, the yoke is attracted toward whichever magnet it is closest to. The state of the actuator is changed by using the actuation current to reinforce the field of the further magnet and reduce the field of the closer magnet until the yoke is pulled toward the further magnet, which then becomes the closer magnet, thereby enabling the actuator to latch in this new position when the actuation current is removed.

The yoke formed as part of the magnetic latching actuator is received within an actuation arrangement that engages the pair of movable contacts and the pair of fixed contacts. Cam channels formed as part of the actuating arrangement engage pegs formed on the movable contacts such that movement of the yoke between the first and second positions causes the actuating arrangement to open and close the movable and fixed contacts.

The first and second permanent magnets and the yoke of the magnetic latching actuator creates an actuator that latches without end stops such that the actuator can be directly connected with low or zero compliance to the contacts being actuated. The end positions of the actuator are determined by the physical contacts being actuated such that the actuator automatically compensates for wear to the contacts. The magnetic latching actuator has an essentially constant latching force with position and the direction of latching force flips over in a small zone around the center of travel of the yoke.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
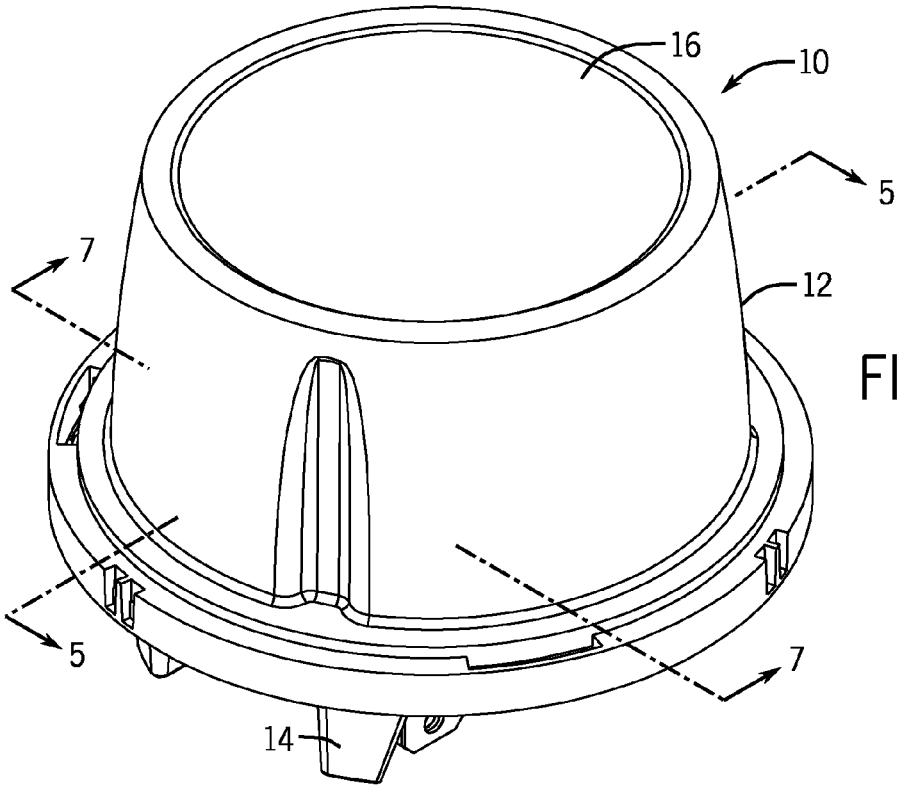
FIG. 1 is a perspective view of an electronic electricity meter incorporating the electrical contactors of the present disclosure.
Figure 2:
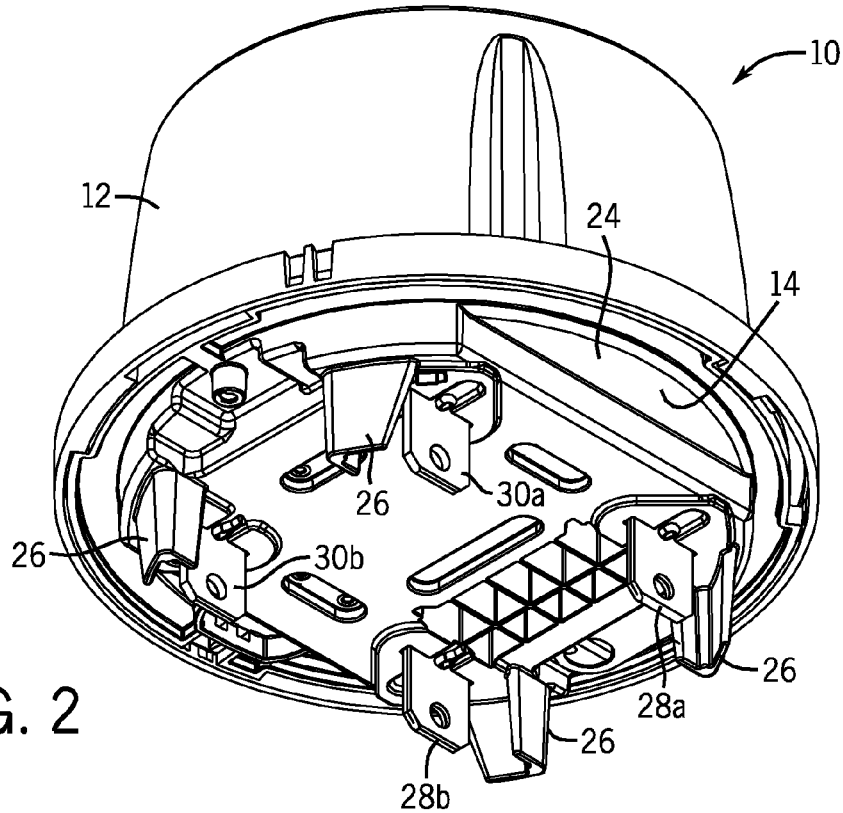
FIG. 2 is a back view of the electricity meter showing the ANSI-standard 2S configuration of the blades of a pair of bus bars.

FIGS. 1 and 2 illustrate an electronic electricity meter 10 in accordance with the present disclosure. The electricity meter 10 includes an enclosed meter housing comprised of a cover member 12 mounted to a base member 14. The cover member 12 includes a generally clear face surface 16 that allows a digital display 18 (FIG. 3) to be read from the exterior of the electricity meter 10. The cover member 12 and base member 14 are joined to each other in a conventional manner such that the base member 14 and the cover member 12 define a sealed meter housing. The meter housing prevents moisture and other environmental contaminants from reaching the internal circuitry contained within the electricity meter 10.

Figure 3:
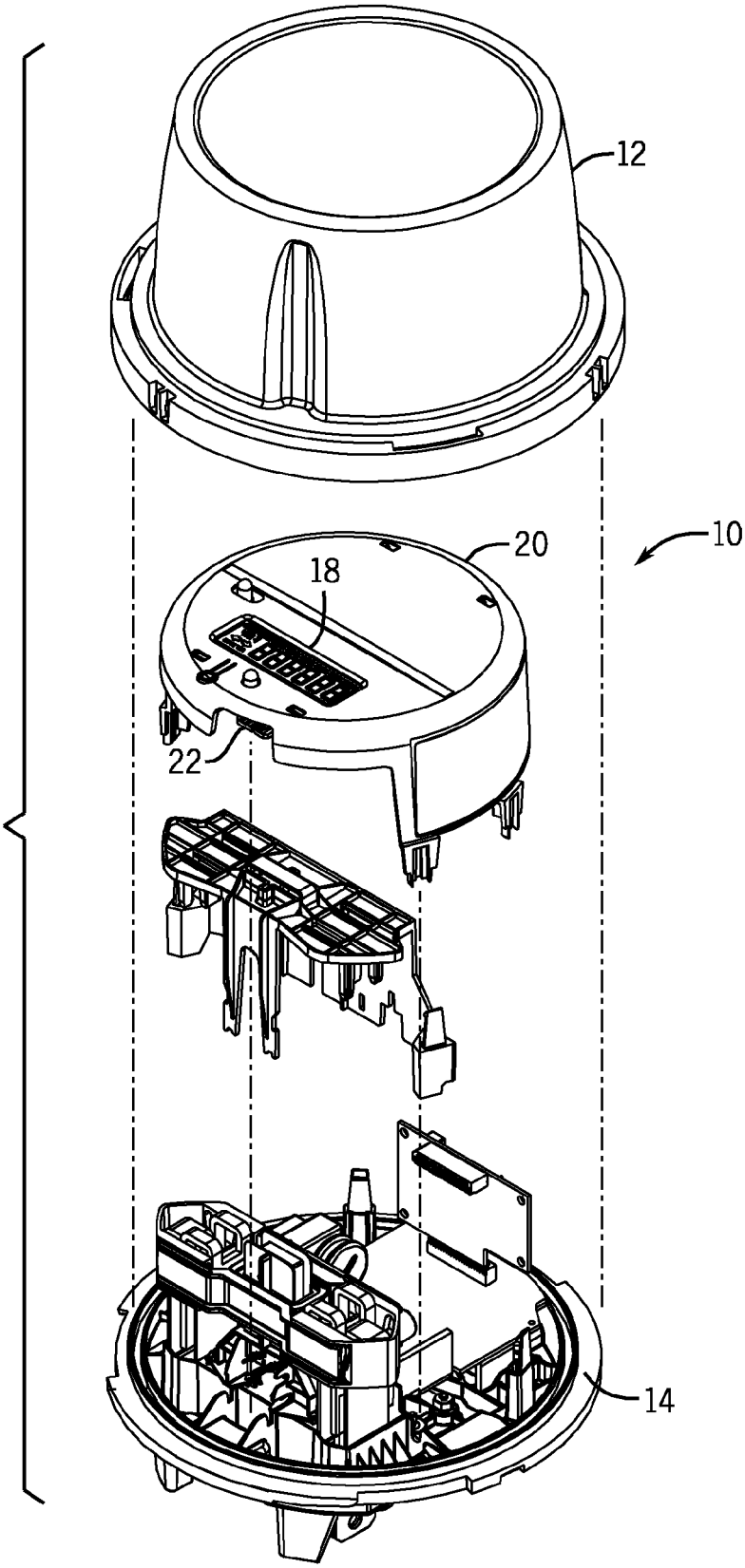
FIG. 3 is an exploded view of the electronic electricity meter.

Referring now to FIG. 3, the electricity meter 10 includes operating and measurement circuitry mounted to the internal support frame 20. The internal circuitry is contained on circuit board 22 and includes circuitry required to monitor the electrical consumption by the home serviced by the electricity meter 10. Additionally, the electronic circuitry contained on the circuit board 22 includes a radio transceiver that can receive external radio frequency messages from locations remote to the electricity meter 10 and transmit energy consumption data from the electricity meter 10 to a remote location. The specific details of the measurement circuitry, the transceiver circuit and other operating components for the electronic electricity meter 10 will not be described in detail, since the measurement circuitry and transmitting circuitry forms no part of the present invention. It should be understood that the measurement circuitry and transmission circuitry could be one of several designs, such as the design shown in PCT/EP2006/009710, the disclosure of which is incorporated by reference.

FIG. 2 illustrates a bottom view of the base member 14 of the electricity meter 10 of the present disclosure. The base member 14 includes a planar base plate 24 that is formed as part of the base member 14. The base plate 24 includes a plurality of support legs 26 spaced evenly around the base plate 24. The support legs 26 stabilize the electricity meter when the electricity meter is installed in a mating socket positioned in line with a supply of electricity to either a residential or commercial location. The support legs 26 are typically formed from molded plastic and are formed integrally with the remaining portions of the base member 14.

The base of the electricity meter 10 further includes a pair of blades 28*a*, 28*b* that are connected to the electricity mains. Each of the first blades 28*a*, 28*b* forms part of a bus bar with a second set of blades 30*a*, 30*b*. When the electricity meter 10 is installed within a meter socket, current flows from the electricity mains through each of the blades 28*a*, 28*b* and out to the home through the blades 30*a*, 30*b*. The blades 30*a*, 30*b* thus supply current to the home or business being supplied electricity through the electronic electricity meter 10. In an electricity meter without any type of disconnect circuitry, the first bus bar between blades 28*a* and 30*a* represents a first phase while the current flow through the second bus bar between the blade 28*b* and the blade 30*b* represents a second phase. As can be understood in FIG. 2, if the flow of current is disrupted from the blade 28*a* to the blade 30*a* and from the blade 28*b* to the blade 30*b*, electrical power will be disconnected from the residence being served by the electricity meter 10.

Figure 4:
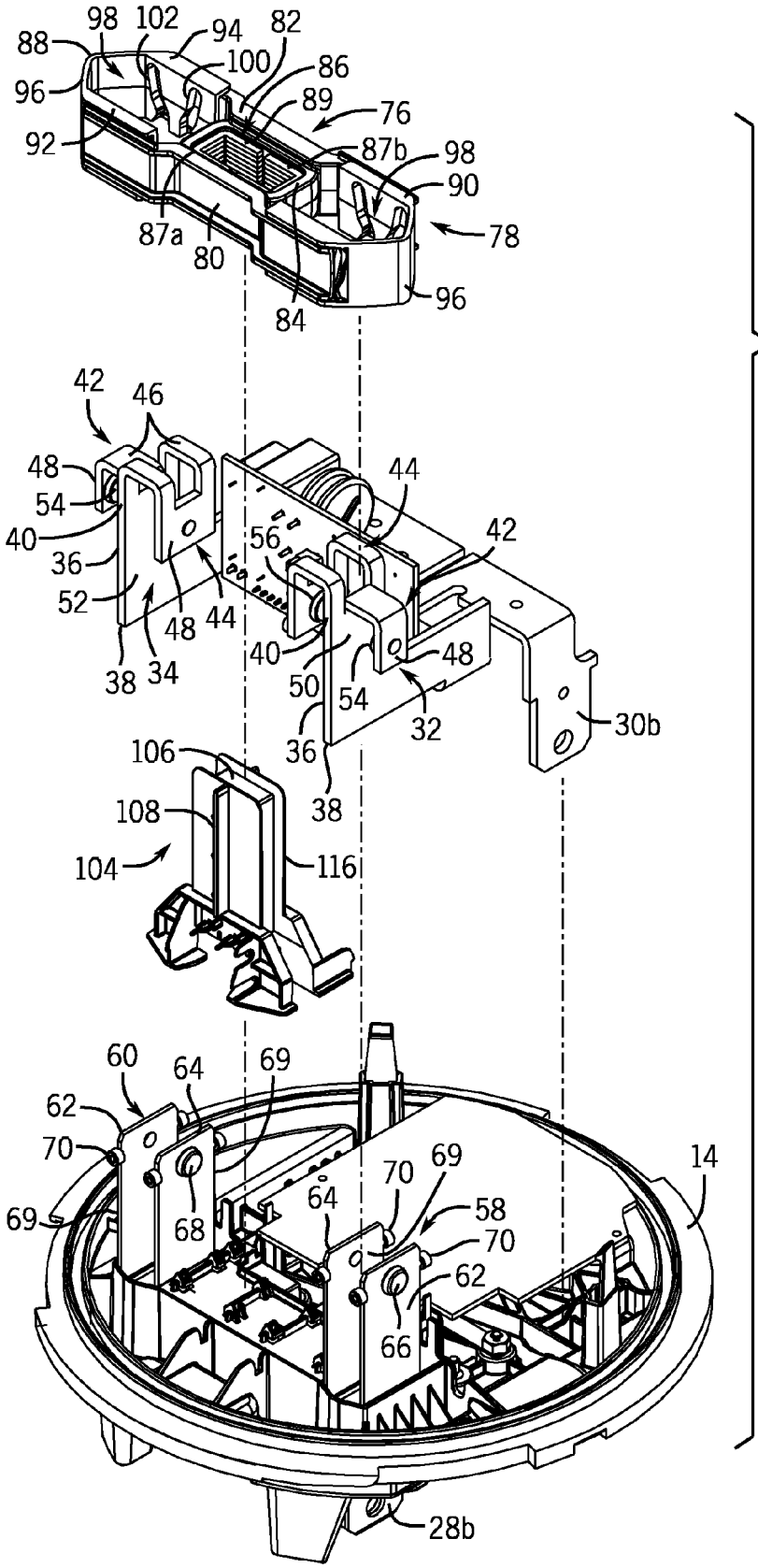
FIG. 4 is a further exploded view of the electrical contactor arrangement of the present disclosure.

Referring now to FIG. 4, the blade 30*b* extends through the base plate 14 into the interior of the meter where it is joined to a first fixed contact 32. A second fixed contact 34 is likewise coupled to the corresponding blade 30*a* (not shown). The fixed contact 32 is electrically connected to the blade 30*b* such that current flows from the fixed contact 32 to the blade 30*b*.

The fixed contacts 32 and 34 each include a center leg 36 that extends along a longitudinal axis from a first end 38 to a second end 40. As illustrated in FIG. 4, the longitudinal axis of the center leg 36 is vertically oriented when the base 14 is horizontal. However, it should be understood that the electricity meter 10 could be installed in various orientations. Thus, the vertical configuration of the center leg 36 is for illustrative purposes only and is not meant to limit the orientation of the device.

The second fixed contact 34 also includes a center leg 36 that extends from the first end 38 to the second end 40. The first and second fixed contacts 32, 34 are generally identical and mirror images of each other.

Each of the first and second fixed contacts 32, 34 includes a first arm 42 and a second arm 44. Both the first and second arms 42, 44 include a spacer section 46 and a pad support portion 48. The spacer section 46 is generally perpendicular to the longitudinal axis of the center leg 36 while the pad support portion 48 is generally parallel to the longitudinal axis of the center leg 36. As can be understood in FIG. 4, the first arm 42 and the second arm 44 extend in opposite directions from the center leg 36. The pad support portion 48 of the first arm 42 is spaced from the center leg 36 by a receiving channel 50 while the pad support portion 48 of the second arm 44 is spaced from the center leg 36 to define a second receiving channel 52.

The first arm 42 of each of the first and second fixed contacts 32, 34 includes a contact pad 54. Likewise, the second arm 44 formed as part of the first and second fixed contacts 32, 34 includes a contact pad 56. The contact pads 54, 56 are conventional items and provide a point of electrical connection to the respective first and second arms 42, 44, as will be discussed in detail below.

The electrical contactor arrangement for the electricity meter further includes a first movable contact 58 and a second movable contact 60. As illustrated, the first movable contact 58 is electrically connected to the blade 28*b* while the second movable contact 60 is connected to the blade 28*a* (not shown).

Figure 7:
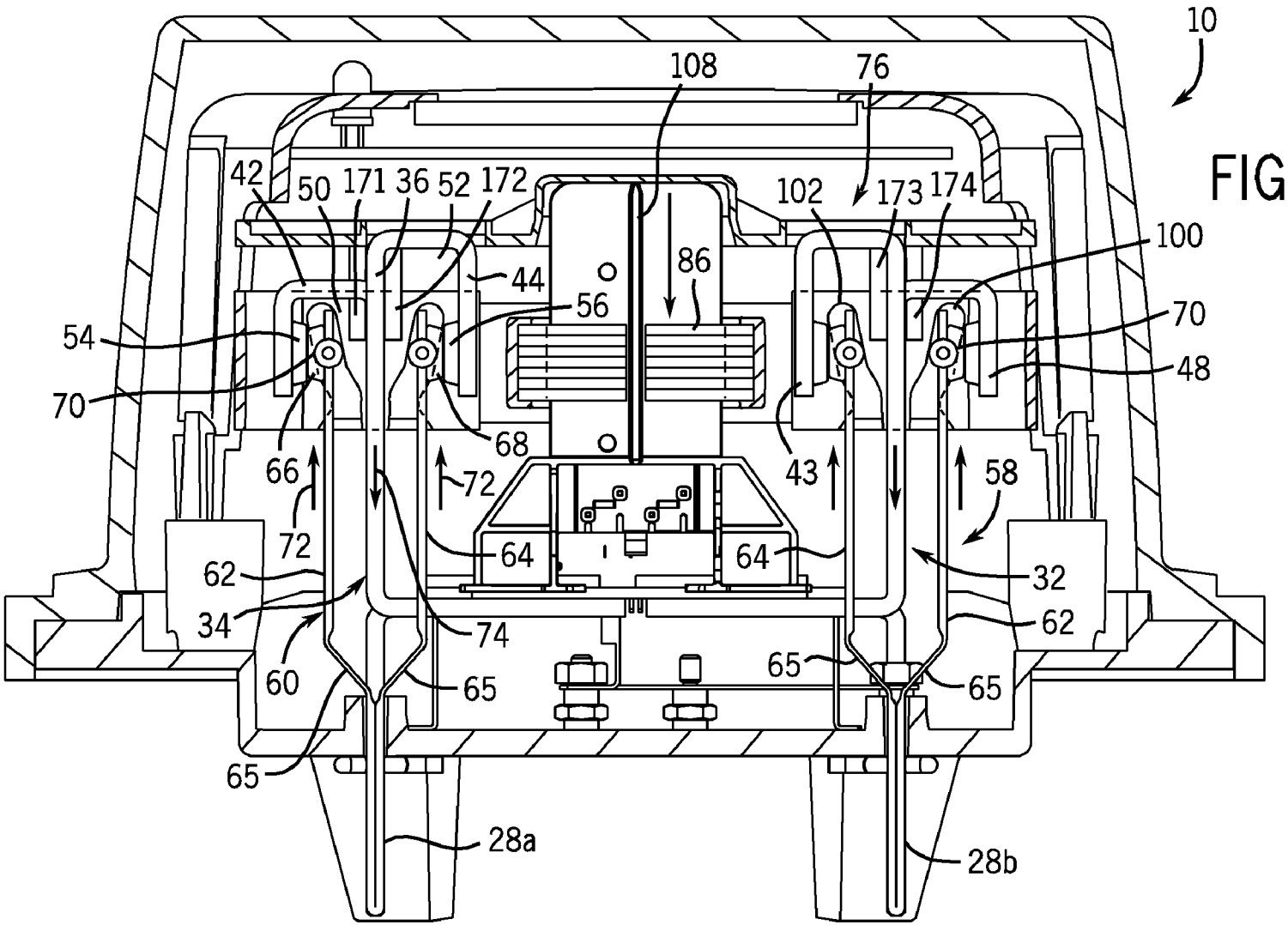
FIG. 7 is a section view taken along line 7-7 of FIG. 1 illustrating the electrical contactor pairs in the closed position.

As illustrated in FIGS. 4 and 7, both of the movable contacts 58, 60 include a first blade 62 and a second blade 64. The first and second blades 62, 64 diverge outwardly from the blades 28*a*, 28*b* and extend generally parallel to each other. The first and second blades 62, 64 are connected to the respective blades 28*a* and 28*b* by a flexing section 65 that allows the blades to deflect, as will be discussed below. In the embodiment shown in FIGS. 4 and 7, each of the first and second blades 62, 64 extends vertically, although it should be understood that the orientation of the electricity meter could be different than shown in FIGS. 4 and 7.

Referring back to FIG. 4, the first blades 62 each include a contact pad 66 while the second blades 64 include a similar contact pad 68. As discussed above, the contact pads 66, 68 provide for a point of electrical connection between the first and second blades of the movable contacts 58, 60 in a manner to be described below.

As illustrated in FIG. 4, each of the first and second blades 62, 64 is a generally planar member defined by a front face surface, a back face surface and a pair of side edges 69. Each of the first and second blades 62, 64 includes a peg 70 extending from each of the side edges 69 of the respective first and second blades 62, 64. In the embodiment illustrated, the pegs 70 are formed as an integral part of the metallic first and second blades 62, 64 during the copper pressing process. It is contemplated that the pegs 70 could be formed or coated with another material, such as plastic, while operating within the scope of the present disclosure. The plastic material used to form the pegs 70 provides for enhanced durability of the pegs 70 during continuous use.

Referring now to FIG. 7, when the electricity meter 10 is assembled, the first blade 62 is received within the receiving channel 50 defined by the space between the center leg 36 and the first arm 42. Likewise, the second blade 62 is received within the receiving channel 52 formed between the second arm 44 and the center leg 36. When the movable contact 60 and the fixed contact 34 are in the closed condition shown in FIG. 7, the contact pad 54 on the first arm 42 engages the contact pad 66 on the first blade 62 while the contact pad 56 on the second arm 44 engages the contact pad 68 on the second blade 64. In this condition, current flows through the first and second blades 62, 64 in the direction shown by arrows 72.

The current flows from the first and second blades 62, 64 and into the respective first and second arms 42, 44 through the respective contact pads. The current then enters the center leg 36 and flows in the direction shown by arrow 74. As illustrated in FIG. 7, since the first and second blades 62, 64 are parallel to the center leg 36, the current flowing through first and second blades 62, 64 is parallel and opposite to the current flowing through the center leg 36. This opposite direction of current flow creates repelling magnetic fields that force the first and second blade 62, 64 to deflect outward and into contact with the first and second arms 42, 44 of the fixed contact. Thus, the configuration shown in FIG. 7 acts to encourage contact between the fixed and movable contacts during normal operation.

In addition to encouraging contact between the fixed and movable contacts during normal operating conditions, the repelling magnetic fields created by the current flow in opposite directions through the first and second blades 62, 64 and the center leg 36 further ensures constant contact during overload and short circuit conditions. During short circuit and testing conditions, the current flowing through the first and second blades 62, 64 and the center leg 36 may be 12,000 Amps peak, which can create repelling magnetic forces of 500 Newtons. Thus, the orientation of the first and second blades 62, 64 and the center leg 36 act to prevent separation of the contacts during the short circuit and testing conditions.

Referring back to FIG. 4, the electrical contactor within the electricity meter includes an actuating arrangement 76 that functions to control the movement of the movable and fixed contacts between a closed, contact condition and an open, short circuit condition. The actuating arrangement 76 includes a plastic armature 78 that is defined by a first rail 80 and a second rail 82. The first and second plastic rails 80, 82 retain a plastic housing 84 that surrounds a yoke 86. In the embodiment illustrated, the yoke 86 includes two separate yoke sections 87*a* and 87*b* separated by a pair of guide slots 89. The yoke 86 could be formed from various types of permeable material, such as steel or iron.

As illustrated in FIG. 4, the first and second rails 80, 82 each receive a first cam member 88 and a second cam member 90. The cam members 88, 90 are identical plastic components that each include a first wall 92 and a second wall 94 that are oriented parallel to each other. The first and second walls 92, 94 are joined by a corner web 96 to define a contact-receiving cavity 98 on each end of the actuating arrangement 76.

Each of the first and second walls 92, 94 of the cam members 88, 90 includes a pair of cam channels 100, 102. The cam channels 100, 102 are formed along an inner wall of each of the first and second walls 92, 94 and are sized to receive the pegs 70 formed on the first and second blades 62, 64 of the movable contacts 58, 60. Further details of the engagement between the cam channels 100, 102 and the movable contacts 58, 60 will be described below.

The actuating arrangement 76 includes an actuator 104. The actuator 104 includes an actuation coil formed from a series of copper windings (not shown) wound around a center section 106. The actuator 104 includes a pair of guide ribs 108 that are received within the corresponding guide slots 89 formed in the yoke 86. The actuator 104 can be activated by the control circuit for the electronic electricity meter to cause movement of the yoke 86 along the guide ribs 108 in a manner to be described below.

Although a specific actuator 104 is shown in the preferred embodiment, it should be understood that various other types of actuators could be utilized while operating within the scope of the present disclosure. Specifically, any kind of electrically activated actuator that is capable of moving the armature 78 and yoke 86 between a first and a second position would be capable of being utilized with the present disclosure.

When the electronic electricity meter 10 of the present disclosure is installed within a meter socket at a customer premise, the electrical contactor arrangement is in the closed condition shown in FIG. 7. When the electrical contactors are in the closed condition, the actuating arrangement 76 is in its first, closed position shown in FIG. 7. In this position, the yoke 86 is in its lower position and each of the pegs 70 formed on the first and second blades 62, 64 of the movable contacts 58, 60 are received in one of the cam channels 100, 102. The configuration of each of the cam channels 100, 102 applies a force to the pegs 70 to urge the respective peg 70 toward the pad support portions 48 of each of the first and second arms 42, 44 of the fixed contacts 32, 34. This force is applied to the first and second blades 62, 64 at a location directly aligned with the contact pads 66 and 68. Thus, in the closed condition of the actuating arrangement 76, current flows through each of the first and second blades 62, 64 and into the first and second arms 42, 44 of the fixed contacts. In this condition, the direction of current flow, as illustrated by arrows 72, 74 in FIG. 7, creates opposing magnetic forces that urge the first and second blades 62, 64 away from the center leg 36 of the fixed contacts 32, 34.

Figure 5:
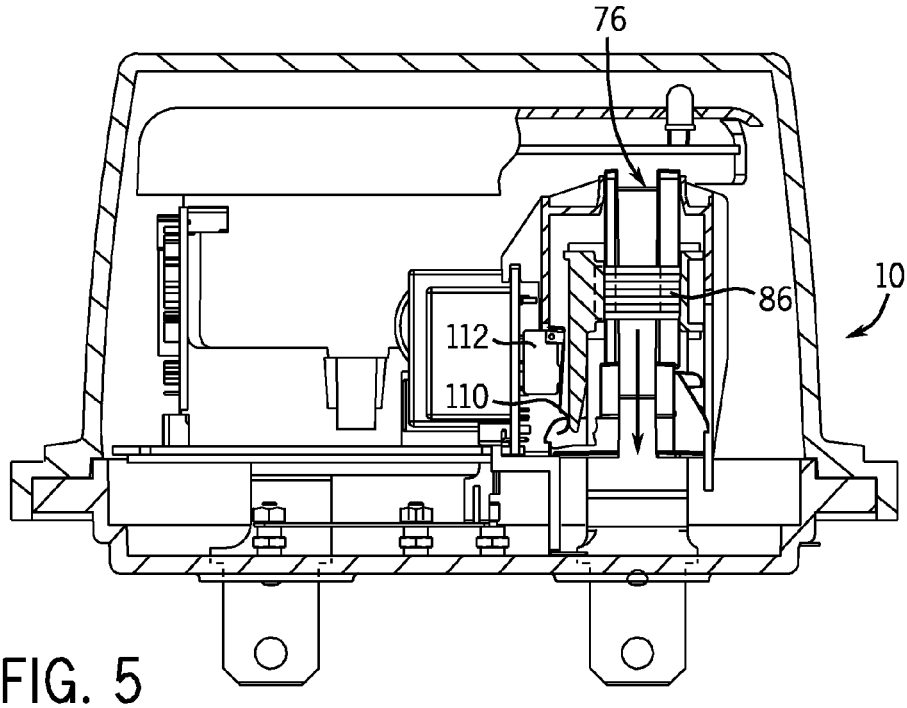
FIG. 5 is a section view taken along line 5-5 of FIG. 1 with the electrical contactor in the closed position.

As illustrated in FIG. 5, when the actuating arrangement 76 is in the closed position, the actuating assembly 76 contacts the trip arm 110 of an indicator switch 112. The movement of the trip arm 110 provides an electronic signal to the controller for the electronic electricity meter to indicate that the actuating arrangement 76 is in the closed position, thereby allowing the flow of current through the electricity meter 10.

Figure 8:
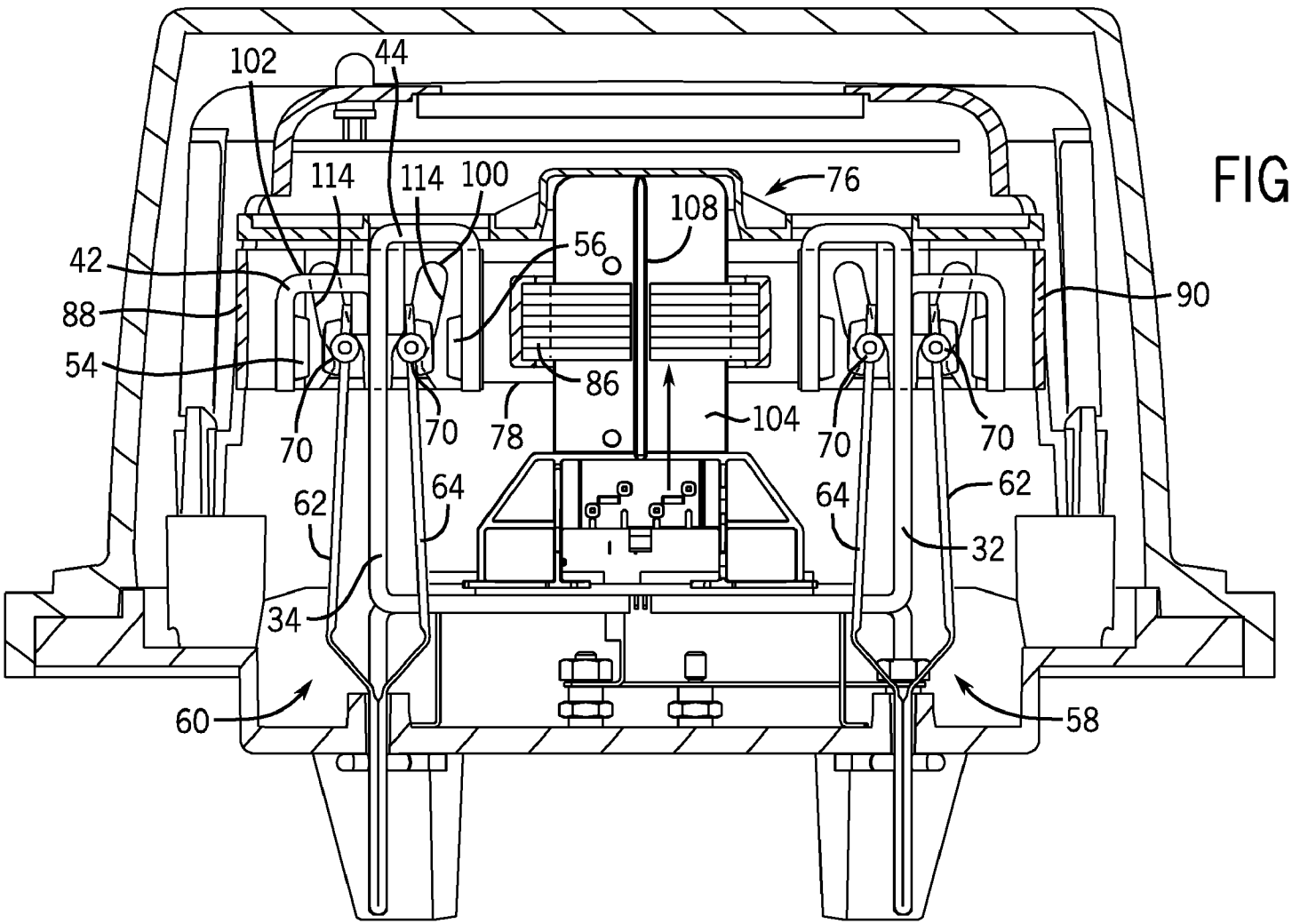
FIG. 8 is a view similar to FIG. 7 illustrating the electrical contactor pairs in the open position.

If, for any reason, it is desired to interrupt the supply of electricity to the premise served by the electricity meter, the control circuit of the electricity meter activates the actuating arrangement 76 to move the actuating arrangement to the open position shown in FIG. 8. Specifically, the control circuit for the electricity meter provides a source of electricity to the actuator 104 which creates a magnetic field through the copper windings of the actuator 104. Upon energization of the actuator, the yoke 86 moves upward along the guide ribs 108 to the open position shown in FIG. 8.

As the yoke 86 moves upward, the armature 78 and the attached cam members 88, 90 also move upward, as illustrated. As the cam members 88, 90 move upward, the pegs 70 contained on each of the first and second blades 62, 64 of the movable contacts 58, 60 contact the inner walls 114 of the cam channels 100, 102. As illustrated in FIG. 8, the inner wall 114 diverges away from the first and second arms 42, 44 of the fixed contacts 32, 34. The configuration of the inner wall 114 thus causes separation between the first and second blades 62, 64 and the first and second arms 42, 44 of the fixed contacts 32, 34. This separation interrupts the flow of current between the fixed contacts 32, 34 and the movable contacts 58, 60. The upward travel of the cam members 88, 90 is stopped by the contact between the first and second blade pairs 62, 64 and the insulating end stops 171, 172, 173 and 174, as shown in FIGS. 7 and 8. The end stops 171-174 are each sections of insulating material attached to the center legs 36 of the fixed contacts 32 and 34. Alternatively, the insulating material could be attached to the back surface of the first and second blades 62, 64 of the movable contacts 58 and 60. In such an embodiment, the insulating material would contact the center legs 36 such that the center legs would function as the end stops.

Thus, upon activation of the actuating arrangement 76, the movement of the armature 78 to the open position shown in FIG. 8 causes the interruption of current flowing through the electricity meter. In the embodiment shown in FIG. 8, the actuator 104 holds the yoke 86 in the position shown in FIG. 8 without the continuous application of electricity to the solenoid. As indicated previously, various other configurations and types of actuators can be utilized while operating within the scope of the present disclosure.

Figure 6:
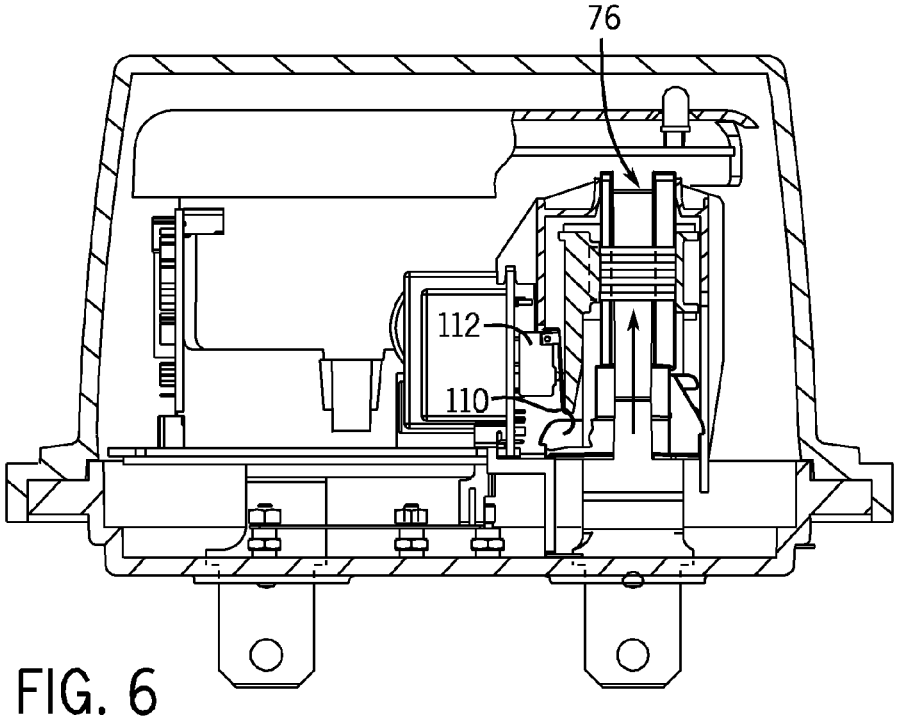
FIG. 6 is a section view similar to FIG. 5 with the electrical contactor in the open position.

Referring now to FIG. 6, when the actuating arrangement 76 is in the open position, the trip arm 110 of the indicator switch 112 extends and provides a signal to the operating components for the electricity meter to indicate that the electrical contactors within the electricity meter have been moved to the open position.

When the user/utility desires to again allow the supply of electricity to the premise, the solenoid actuator 104 of the actuating arrangement 76 is again actuated to cause the actuating arrangement 76 to move from the open position of FIG. 8 to the closed position of FIG. 7. Once again, the interaction between the cam channels 100, 102 and the pegs 70 contained on the first and second blade 62, 64 returns the contactors to a condition in which current can flow through the electronic electricity meter 10.

As described with reference to FIG. 4, the actuating arrangement 76 includes an actuator 104 that is operable to effect the movement of the armature 78 to move the movable contacts 58, 60 between their open and closed positions. As described, the actuator 104 could have various different configurations while operating within the scope of the present disclosure. FIGS. 9-13 illustrate two contemplated embodiments of the actuator 104.

Figure 9:
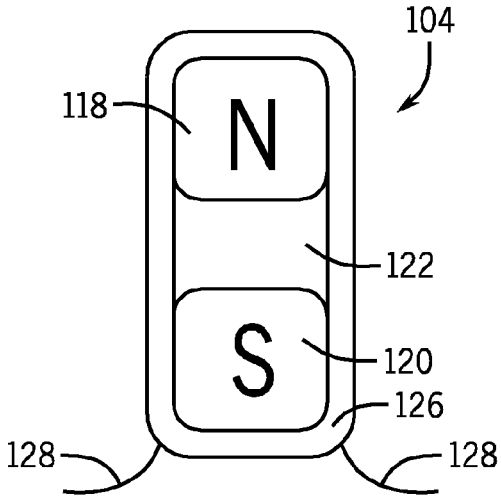
FIG. 9 is a schematic illustration of the internal structure of the actuator of the present disclosure.
Figure 10:
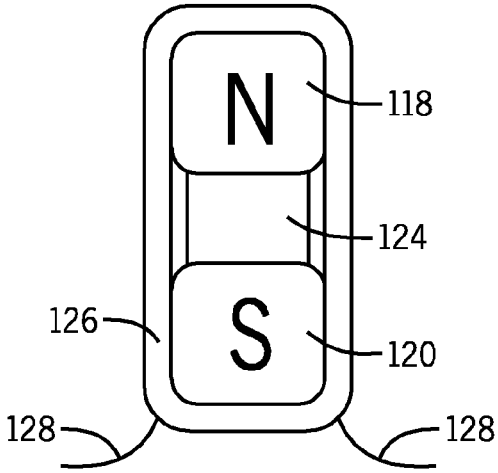
FIG. 10 is an alternate embodiment of the actuator shown in FIG. 9.

FIG. 9 illustrates the internal operating components of the actuator 104 with the magnet case 116 (FIG. 4) removed. As illustrated in FIG. 9, the actuator 104 includes a first magnet 118 and a second magnet 120. In the embodiment illustrated in FIG. 9, the first magnet 118 is polarized in a first direction while the second magnet 120 is polarized in a second, opposite direction such that the first and second magnets 118, 120 create opposite and opposing magnetic fields. In the embodiment shown in FIG. 9, the first and second magnets 118, 120 are separated by an air gap 122. In a second embodiment shown in FIG. 10, the air gap 122 of FIG. 9 is replaced by a pole piece 124 formed of a permeable material. The pole piece 124 enhances the magnetic field generated by a series of copper windings that form the actuation coil 126. The copper windings of the actuation coil 126 are connected to a supply of electricity through a pair of leads 128.

During operation of the actuator 104, when electricity is supplied to the actuation coil 126 in a first direction, the magnetic field created by the actuation coil 126 enhances the magnetic field created by the first magnet 118 while at the same time effectively cancelling the magnetic field created by the second magnet 120. When the control circuit of the electricity meter reverses the direction of current applied to the actuation coil 126, the polarity of the magnetic field created by the actuation coil 126 reverses, thereby enhancing the magnetic field created by the second magnet 120 while effectively cancelling the magnetic field created by the first magnet 118. Thus, by controlling the direction of current flow through the actuation coil 126 of the actuator 104 through the leads 128, the control circuit of the electricity meter can control the direction of the magnetic field generated by the actuator 104.

Figure 11:
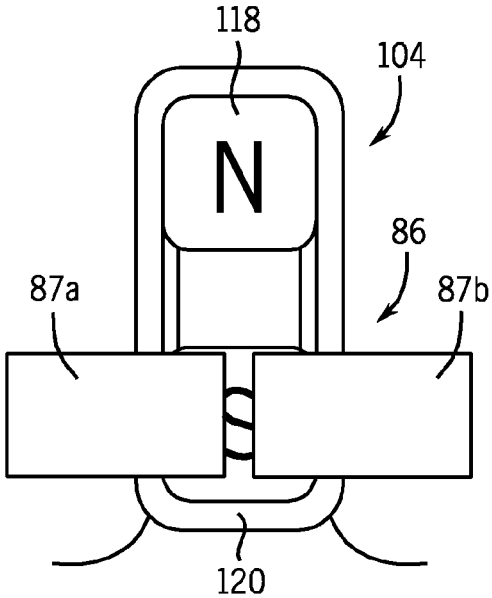
FIG. 11 is a schematic illustration of the movable yoke in a first position along the actuator.
Figure 12:
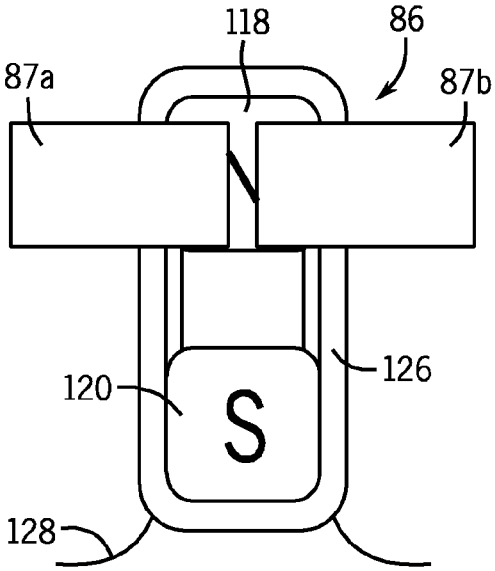
FIG. 12 is a schematic illustration of the movable yoke in a second position along the actuator.

Referring now to FIGS. 11 and 12, the actuator 104 is shown with the yoke 86 positioned for movement relative to the stationary first and second magnets 118, 120. In the embodiment of FIGS. 11 and 12, the yoke 86 includes the pair of yoke sections 87*a* and 87*b*. The yoke sections 87*a* and 87*b* are each mounted within the plastic housing 84 (FIG. 4), which is not shown in FIGS. 11 and 12.

In FIG. 11, the yoke 86 is shown in its lower position, similar to the position shown in FIG. 7. In this lower position, the movable contacts 58, 60 are in contact with the fixed contacts 32, 34, respectively. In this position, the magnetic field created by the second magnet 120 holds the yoke 86.

When it is desired to move the yoke 86 from the lower position of FIG. 11 to the upper position of FIG. 12, an electric current is applied to the windings of the actuation coil 126 such that the magnetic field created by the actuation coil 126 cancels the magnetic field generated by the second magnet 120 while enhancing the magnetic field created by the first magnet 118. As the magnetic field of the first magnet 118 is enhanced and the magnetic field of the second magnet 120 is cancelled, the magnetic field pulls the yoke 86 to the upper position shown in FIG. 12. Once the yoke 86 reaches the upper position, current is removed from the actuation coil 126 such that the magnetic field created by the first magnet 118 holds the yoke 86 in the upper position.

When the yoke 86 is in the upper position shown in FIGS. 8 and 12, the movable contacts 58, 60 are separated from the fixed contacts 32, 34, as shown in FIG. 8.

When it is desired to re-close the contacts by moving the yoke 86 from the upper position of FIG. 12 to the lower position of FIG. 11, current is applied to the actuation coil 126 in an opposite direction such that the magnetic field created by the actuation coil 126 cancels the magnetic field created by the first magnet 118 while enhancing the magnetic field created by the second magnet 120. The enhanced magnetic field of the second magnet 120 and the cancelled magnetic field of the first magnet 118 causes the yoke 86 to move to the lower position, as shown in FIG. 11.

Figure 13:
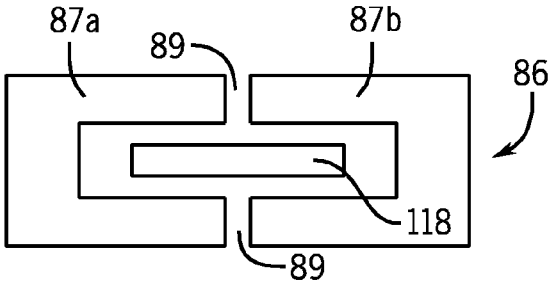
FIG. 13 is a top view illustrating the position of the yoke relative to the permanent magnets of the actuator assembly.

As can be understood by the top view of FIG. 13, the open slots 89 formed between the yoke sections 87*a* and 87*b* allow the yoke 86 to be guided along the guide ribs 108 formed on the magnetic case 116 (FIG. 4).

As can be understood in FIGS. 7 and 11, the lower position of the yoke 86 is controlled by the physical contact between the contact pads 66, 68 formed on the first blade 62 and second blade 64 with the corresponding contact pads 54, 56 formed on the first and second arms 42, 44 of the fixed contacts 32, 34. Specifically, the magnetic force created by the second magnet 120 pulls the yoke 86 downward until the contact pads engage each other. Thus, when the contact pads are new and have very little wear, the lower position of the yoke 86 will be at a rest point that occurs before the yoke 86 has moved completely along the entire second magnet 120. Thus, as the contact pads wear, the yoke 86 still has the ability to move further downward, thus causing the contact pads to contact each other even after wear has occurred.

In the upper position of the yoke, as shown in FIGS. 8 and 12, the amount of travel of the yoke 86 must be sufficient to separate the contacts as shown in FIG. 8.

As can be understood in FIGS. 7 and 8, when the yoke 86 moves between the lower position (FIG. 7) and the upper position (FIG. 8), the cam channels 100, 102 formed in the armature 78 exert a force on the pegs 70 of each of the movable contacts. This force is exerted on the contact at a location aligned with the contact pads. Thus, the force applied to the movable contacts is constant, regardless of the contact pad wear.

Although the actuator 104 shown in FIGS. 9-13 is coupled to the movable contact through an armature arrangement, it is contemplated that various other attachment methods between the actuator 104 and movable contacts are contemplated while being within the scope of the present disclosure.

As can be understood in the foregoing description, the configuration of the fixed and movable contacts is such that a center leg of the fixed contact is positioned between the movable first and second blades of the movable contacts. The first and second blades are oriented parallel to the center leg such that during current flow through the meter, current flows in opposite directions within the center leg as compared to the first and second blades of the movable contacts. The opposite direction of current flow creates a magnetic force that forces both the first and second blades outward away from the center leg. Since the contact pads for the fixed contacts are positioned outward from the first and second blades, this repulsive force aids in holding the movable contacts in the closed condition.

We claim:

1. An electrical contactor comprising:

a fixed contact having a center leg extending along a longitudinal axis between a first end and a second end, wherein the second end of the fixed contact includes a first arm and a second arm each extending in opposite directions from the center leg;

a movable contact having a first blade and a second blade, wherein the movable contact is positioned such that the first blade is located between the first arm and the center leg of the fixed contact and the second blade is located between the second arm and the center leg of the fixed contact; and an actuating arrangement positioned to engage both the first and second blades of the movable contact, wherein the actuating arrangement is movable between a closed position in which the actuating arrangement forces the first blade into contact with the first arm and simultaneously forces the second blade into contact with the second arm and an open position in which the actuating arrangement forces the separation of the first blade and the first arm and forces the separation between the second blade and the second arm.

2. The electrical contactor of claim 1 wherein when the actuating arrangement is in the closed condition, current flows through the center leg of the fixed contact from the first end to the second end and current flows through the first and second blades of the movable contact in a direction opposite the current flow through the center leg of the fixed contact to create a magnetic force that repels each of the first and second blades away from the center leg of the fixed contact.

3. The electrical contactor of claim 2 wherein the magnetic force created by the current flow through the first and second blades of the movable contact and through the center leg of the fixed contact repels the first blade into contact with the first arm and repels the second blade into contact with the second arm.

4. The electrical contactor of claim 1 wherein each of the first and second blades includes at least one peg that is received within a cam channel formed in the actuating arrangement.

5. The electrical contactor of claim 4 wherein the actuating arrangement includes an armature that receives a cam member including the cam channel, wherein the armature is movable in a direction parallel to the longitudinal axis of the center leg of the fixed contact and the cam channel is configured to move the first and second blades toward and away from the center leg.

6. The electrical contactor of claim 1 wherein the actuating arrangement includes an electromagnetic actuator that is selectively activated to move the actuating arrangement between the open and closed positions.

7. The electrical contactor of claim 6 wherein the electromagnetic actuator is remotely actuatable.

8. The electrical contactor of claim 1 wherein the first and second blades each contact an end stop upon separation from the first and second arms to limit the movement of the first and second blades.

9. The electrical contactor of claim 8 wherein the end stops are formed from insulating material attached to the center leg of the fixed contact.

10. The electrical contactor of claim 8 wherein the each of the first and second blades includes insulating material that contacts the end stops formed on the center leg of the fixed contact.

11. A two pole electrical contactor comprising:

a pair of fixed contacts each having a center leg, a first arm and a second arm, wherein the first and second arms extend away from the center leg in opposite directions;

a pair of movable contacts each having a first blade and a second blade, wherein the first blade of each movable contact is positioned between the first arm and the center leg of one of the fixed contacts and the second blade is positioned between the second arm and the center leg of one of the fixed contacts; and an actuating arrangement positioned to engage the first and second blades of both of the movable contacts, wherein the actuating arrangement is movable between a closed position in which the actuating arrangement forces the first blade of each movable contact into contact with the first arm of the fixed contact and simultaneously forces the second blade of each movable contact into engagement with the second arm of the fixed contact and an open position in which the actuating arrangement separates the first blade of each movable contact and the first arm on the fixed contact and separates the second blade of each movable contact and the second arm of the fixed contact.

12. The two pole electrical contactor of claim 11 wherein the actuating arrangement includes a pair of cam members each including a cam channel, wherein each of the cam channels receives a peg mounted to each of the first and second blades of the movable contacts.

13. The two pole electrical contactor of claim 11 wherein when the actuating arrangement is in the closed condition, current flows through the center leg of each of the fixed contacts along the longitudinal axis of the center leg and current flows through the first and second blades of the movable contacts in a direction opposite the current flow through the center leg of the fixed contacts to create a magnetic force that repels each of the first and second blades away from the center leg of the fixed contact.

14. The two pole electrical contactor of claim 13 wherein the magnetic force created by the current flow through the first and second blades of the movable contact and through the center leg of the fixed contact repels the first blade into contact with the first arm and repels the second blade into contact with the second arm.

15. The two pole electrical contactor of claim 11 wherein the first and second blades of each movable contact include a pair of pegs that are each received within a cam channel formed in the actuating arrangement.

16. The two pole electrical contactor of claim 15 wherein the actuating arrangement includes an armature that receives a pair of cam members each including the cam channel, wherein the armature is movable along the longitudinal axis of the center leg of the fixed contact and the cam channel is configured to move the first and second blades toward and away from the center leg.

17. The two pole electrical contactor of claim 16 wherein the actuating arrangement further includes an electromagnetic actuator that is selectively activated to move the actuating arrangement between the open and closed positions.

18. The two pole electrical contactor of claim 17 wherein the electromagnetic actuator is remotely actuatable.

19. A movable contact set for an electrical contactor, comprising:

a fixed contact having a center leg extending along a longitudinal axis, a first arm and a second arm, wherein the first and second arms extend in opposite directions from the center leg;

a movable contact having first and second blades extending generally parallel to each other and located on opposite sides of the center leg, wherein the first blade is positioned between the center leg and the first arm and the second blade is positioned between the center leg and the second arm, wherein the contact set is arranged such that when the contact set is in a closed condition, the first blade engages the first arm and the second blade engages the second arm such that current flows through the first and second blades in an opposite direction to the current flow through the center leg of the fixed contact to create a magnetic force that forces the first and second blades toward the first and second arms, respectively.

20. The movable contact set of claim 19 wherein each of the first and second blades includes one or more contact pads and each of the first and second arms of the fixed contact includes one or more contact pads.

21. The movable contact set of claim 20 wherein the first and second arms of the fixed contact each include a spacing section connected to the center leg and extending perpendicular to the center leg and a pad support section coupled to the horizontal section and extending parallel to the center leg and perpendicular to the spacer section, wherein each of the pad support sections includes the contact pad.

22. The movable contact set of claim 21 wherein the pad support section of each of the first and second arms is spaced from the center leg by a receiving channel, wherein the receiving channel formed by the first arm and the center leg of the fixed contact receives the first blade and the receiving channel formed between the second arm and the center leg of the fixed contact receives the second blade.

23. The movable contact set of claim 22 wherein the first and second blades extend parallel to the longitudinal axis of the center leg.

* * * * *